US009653229B2

(12) United States Patent
Annerino et al.

(10) Patent No.: US 9,653,229 B2
(45) Date of Patent: May 16, 2017

(54) ELECTRONIC DEVICE

(71) Applicant: Wistron Corporation, New Taipei (TW)

(72) Inventors: Frank Annerino, New Taipei (TW); Andrew Rosenkranz, New Taipei (TW)

(73) Assignee: Wistron Corporation, New Taipei (TW)

( * ) Notice: Subject to any disclaimer, the term of this patent is extended or adjusted under 35 U.S.C. 154(b) by 9 days.

(21) Appl. No.: 14/835,674

(22) Filed: Aug. 25, 2015

(65) Prior Publication Data

US 2017/0062150 A1 Mar. 2, 2017

(51) Int. Cl.

*H01H 21/08* (2006.01)
*H01H 13/06* (2006.01)
*H01H 13/14* (2006.01)

(52) U.S. Cl.

CPC ..... *H01H 13/14* (2013.01); *H01H 13/06* (2013.01); *H01H 21/08* (2013.01); *H01H 2231/022* (2013.01)

(58) Field of Classification Search

CPC ..... H01H 13/06; H01H 13/14; H01H 21/06; H01H 21/08; H01H 21/085; H01H 23/06

USPC ..... 200/343, 302.2

See application file for complete search history.

(56) References Cited

U.S. PATENT DOCUMENTS 4,387,282 A * 6/1983 Latasiewicz ..... H01H 21/24 200/343
4,434,340 A * 2/1984 Kondo ..... H01H 21/22 200/330
5,347,427 A * 9/1994 Kinoshita ..... H01H 9/161 200/332.1
5,664,668 A * 9/1997 Zainal ..... H01H 21/22 200/330
5,749,457 A * 5/1998 Castaneda ..... H01H 21/22 200/343
5,760,356 A * 6/1998 Garcia ..... H01H 21/24 200/302.1
5,813,520 A * 9/1998 Reier ..... H01H 21/22 200/330
6,972,385 B2 * 12/2005 Krebs ..... H01H 13/64 200/1 B
7,420,136 B2 * 9/2008 Goetzl ..... H01H 13/06 200/302.2

* cited by examiner

*Primary Examiner* — Felix O Figueroa
(74) *Attorney, Agent, or Firm* — Winston Hsu; Scott Margo

(57) ABSTRACT

A portable electronic device includes a casing with a casing pivotal portion and a key device. The key device is installed on the casing and includes a button cap. The button cap includes a cap pivotal portion, a first cap body and a second cap body. The cap pivotal portion is pivoted to the casing pivotal portion. The first cap body extends from the cap pivotal portion along a first axis. The second cap body extends from the first cap body along a second axis. The button cap rotates in an activating direction when the first cap body is applied by an external force along the first axis or when the second cap body is applied by the external force along the second axis.

14 Claims, 3 Drawing Sheets

ELECTRONIC DEVICE

BACKGROUND OF THE INVENTION

1. Field of the Invention

The present invention relates to an electronic device, and more particularly, to a portable electronic device with a key device with capability of dual axis actuation.

2. Description of the Prior Art

A portable electronic device, such as a mobile phone, a tablet computer and so on, is equipped with a key device for inputting instructions, such as activating a graphical user interface, turning on the portable electronic device and so on. A conventional key device provides a user with a single a single axis, i.e., the user is only able to press the key device along one pressing direction, resulting in lack of flexibility of operation of the key device.

SUMMARY OF THE INVENTION

The present invention provides a portable electronic device with a key device with capability of dual axis actuation for solving above drawbacks.

According to an embodiment of the present invention, a portable electronic device includes a casing and a key device. The casing has a casing pivotal portion. The key device is installed on the casing and includes a button cap. The button cap includes a cap pivotal portion, a first cap body and a second cap body. The cap pivotal portion is pivoted to the casing pivotal portion. The first cap body extends from the cap pivotal portion along a first axis. The second cap body extends from the first cap body along a second axis. The button cap rotates in an activating direction when the first cap body is applied by an external force at a first position spaced from the cap pivotal portion by a first distance along the first axis or when the second cap body is applied by the external force at a second position spaced from the cap pivotal portion by a second distance along the second axis.

According to another embodiment of the present invention, the casing includes a rear housing and a front housing. The front housing is installed on the rear housing, wherein the casing pivotal portion is disposed on the front housing.

According to another embodiment of the present invention, the rear housing has an outer lateral wall, an inner separating wall and a flange retention structure protruding from the outer lateral wall. A cap moving space is defined between the outer lateral wall and the inner separating wall, and the second cap body is movably disposed inside the cap moving space. The button cap further includes a flange structure protruding from the second cap body. The flange structure abuts against the flange retention structure when the button cap rotates in a released direction opposite to the activating direction.

According to another embodiment of the present invention, a containing space is formed inside the casing, and the inner separating wall separates the cap moving space from the containing space. A through hole is formed on the inner separating wall and communicates the cap moving space with the containing space. The electronic device includes a circuit board installed inside the containing space, and the key device further includes a switch and a plug member. The switch is coupled to the circuit board. The plug member plugs in the through hole, and the second cap body drives the plug member to activate the switch when the button cap rotates in the activating direction.

According to another embodiment of the present invention, the key device further includes a plunger member disposed between the second cap body and the plug member.

According to another embodiment of the present invention, the plunger member includes a plunger body, an abutting portion and a plunger combining portion. The plunger body is located in the cap moving space. The abutting portion is connected to an end of the plunger body and abuts against the second cap body. The plunger combining portion is connected to another end of the plunger body and combines with the plug member.

According to another embodiment of the present invention, the plug member includes a plug body, a first water-proof flange, a plug activating portion, a second water-proof flange and a plug combining portion. The plug body has a recessed space formed therein and seals the through hole. The first water-proof flange protrudes from an end of the plug body and seals an opening from the cap moving space to the through hole. The plug activating portion is connected to another end of the plug body and contacts with the switch, and the plug activating portion seals an opening from the recessed space to the containing space. The second water-proof flange protrudes from the plug activating portion and seals an opening from the through hole to the containing space. The plug combining portion protrudes from the plug activating portion and combines with the plunger combining portion.

According to another embodiment of the present invention, the first cap body has a first outer surface, and the second cap body has a second outer surface. The casing has a first casing surface and a second casing surface. The first outer surface corresponds to the first casing surface, and the second outer surface corresponds to the second casing surface.

According to another embodiment of the present invention, the casing pivotal portion is a protruding rib, and the cap pivotal portion is a recessed slot.

According to another embodiment of the present invention, the first axis is perpendicular to the second axis.

In summary, the button cap of the key device includes the cap pivotal portion pivoted to the casing pivotal portion of the casing of the electronic device, and further the button cap includes the first cap body extends from the cap pivotal portion along the first axis, and the second cap body extends from the first cap body along the second axis. As a result, the user is able to selectively touch the first cap body or the second cap body to drive the button cap to rotate in the activating direction, so as to activate the switch for generating the input instruction, such as activating a graphical user interface, turning on the electronic device and so on.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
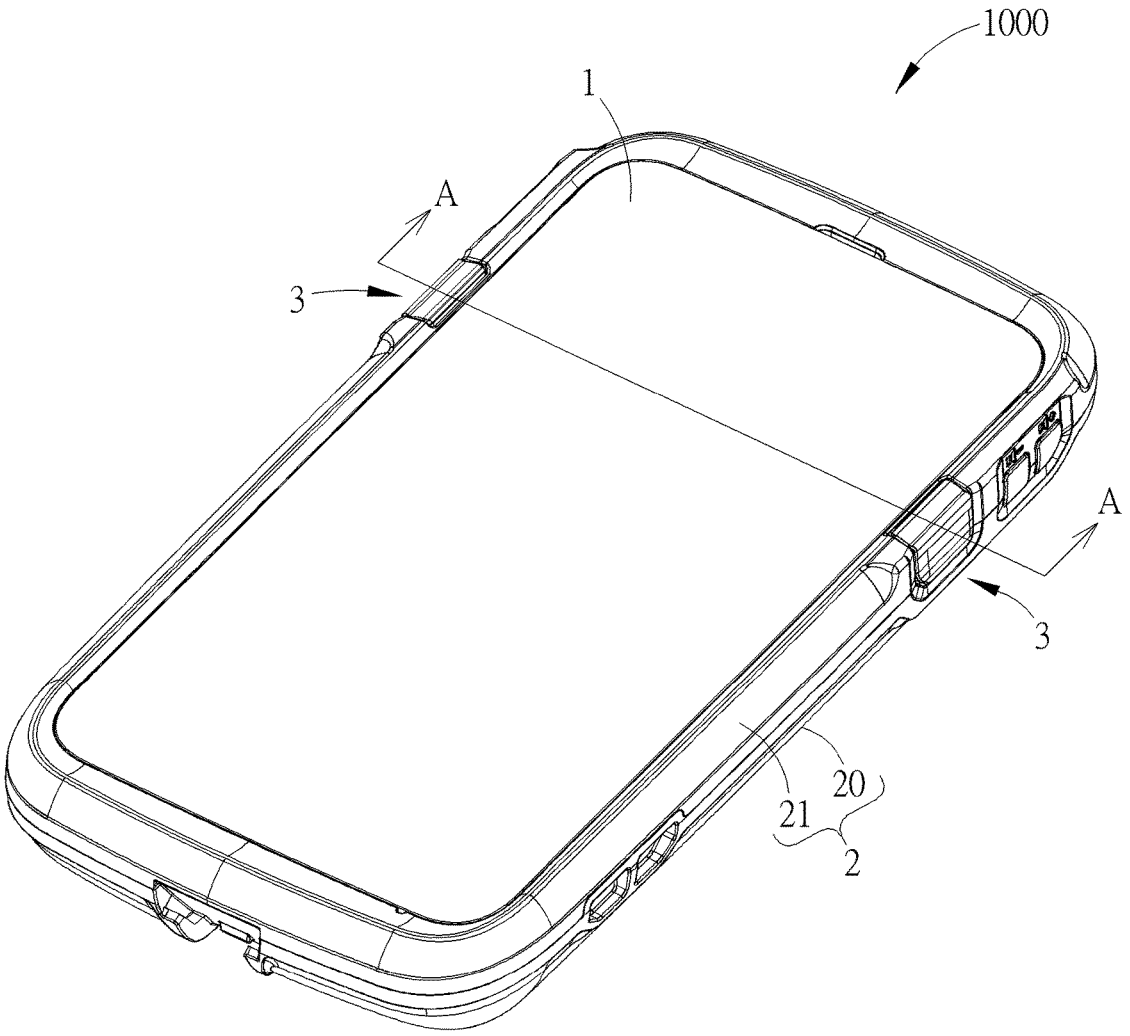
FIG. 1 is a schematic diagram of an electronic device according to an embodiment of the present invention.

Please refer to FIG. 1. FIG. 1 is a schematic diagram of an electronic device 1000 according to an embodiment of the present invention. As shown in FIG. 1, the electronic device 1000 includes a panel module 1, a casing 2 and a key device 3. The panel module 1 is installed on the casing 2 and for displaying a graphic user interface. The key device 3 is installed on a corner of the casing 2 and for inputting instructions, such as activating the panel module 1 for displaying the graphical user interface, turning on the electronic device 1000 and so on. In this embodiment, the electronic device 1000 is a portable electronic device, such as a mobile phone, a tablet computer and so on, but the present invention is not limited thereto.

Figure 2:
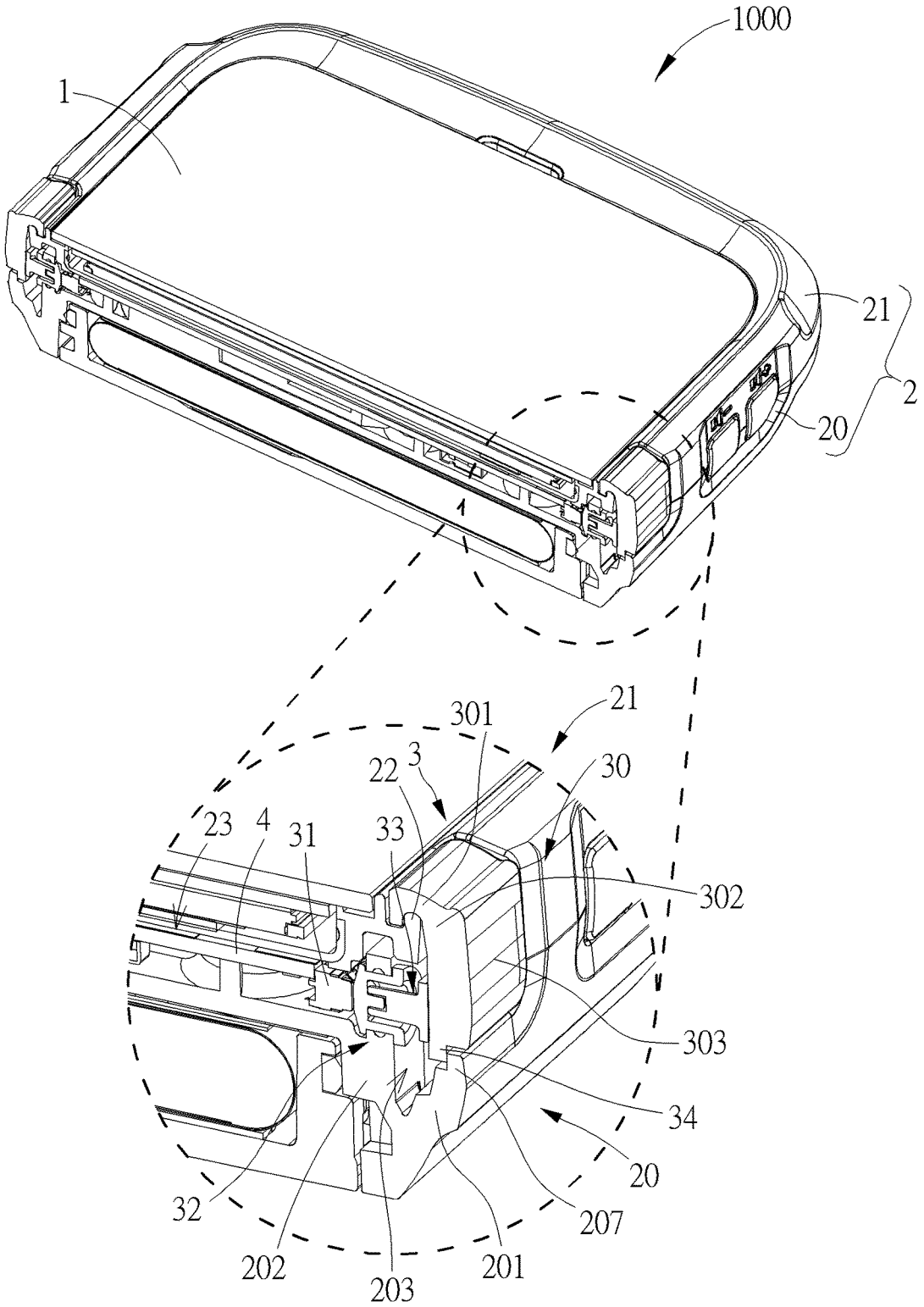
FIG. 2 is a sectional diagram of the electronic device along a section line A-A shown in FIG. 1 according to the embodiment of the present invention.
Figure 3:
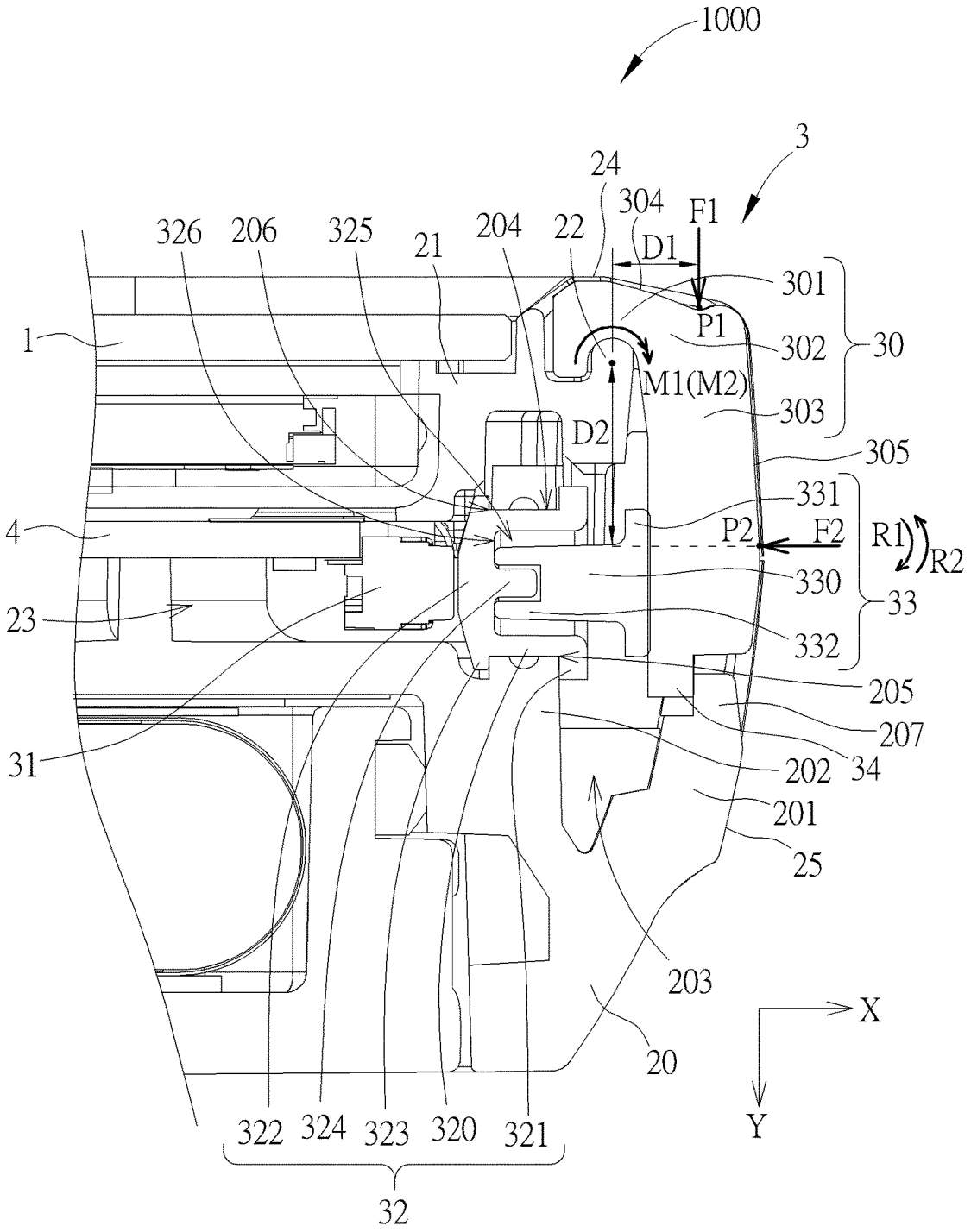
FIG. 3 is an enlarged sectional diagram of the electronic device shown in FIG. 2 according to the embodiment of the present invention.

Please refer to FIG. 1 to FIG. 3. FIG. 2 is a sectional diagram of the electronic device 1000 along a section line A-A shown in FIG. 1 according to the embodiment of the present invention. FIG. 3 is an enlarged sectional diagram of the electronic device 1000 shown in FIG. 2 according to the embodiment of the present invention. As shown in FIG. 1 to FIG. 3, the casing 2 includes a rear housing 20, a front housing 21 and a casing pivotal portion 22. The front housing 21 is installed on the rear housing 20. In this embodiment, the panel module 1 is installed on the front housing 21, and the casing pivotal portion 22 is disposed on the front housing 21. Furthermore, a containing space 23 is formed inside the casing 2, and the rear housing 20 of the casing 2 has an outer lateral wall 201 and an inner separating wall 202, wherein a cap moving space 203 is defined between the outer lateral wall 201 and the inner separating wall 202, and the inner separating wall 202 separates the cap moving space 203 from the containing space 23. A through hole 204 is formed on the inner separating wall 202 and communicates the cap moving space 203 with the containing space 23.

In addition, the electronic device 1000 further includes a circuit board 4 disposed inside the containing space 23. The key device 3 is installed on the front housing 21 of the casing 2 and includes a button cap 30, a switch 31, a plug member 32 and a plunger member 33. The button cap 30 is pivoted to the front housing 21 of the casing 2, such that the button cap 30 is able to rotate relative to the casing 2. The switch 31 is coupled to the circuit board 4. The plug member 32 plugs in the through hole 204. Furthermore, the button cap 30 includes a cap pivotal portion 301, a first cap body 302 and a second cap body 303. The cap pivotal portion 301 is pivoted to the casing pivotal portion 22, such that the button cap 30 is able to rotate about the casing pivotal portion 22 of the casing 2.

In this embodiment, the casing pivotal portion 22 is a protruding rib, and the cap pivotal portion 301 is a recessed slot. The protruding rib (i.e. the casing pivotal portion 22) is rotatably engaged in the recessed slot (i.e. the cap pivotal portion 301). Accordingly, the cap pivotal portion 301 is pivoted to the casing pivotal portion 22, such that the button cap 30 is able to rotate about the casing pivotal portion 22 of the casing 2 and the second cap body 303 is movably disposed inside the cap moving space 203. Structures of the cap pivotal portion 301 and the casing pivotal portion 22 are not limited to those illustrated in figures in this embodiment, and it depends on practical demands.

As shown in FIG. 1 to FIG. 3, the first cap body 302 extends from the cap pivotal portion 301 along a first axis X, and the second cap body 303 extends from the first cap body 302 along a second axis Y. In practical application, the first axis X is perpendicular to the second axis Y, but the present invention is not limited thereto. Furthermore, the plunger member 33 is disposed between the second cap body 303 of the button cap 30 and the plug member 32. In addition, the plunger member 33 includes a plunger body 330, an abutting portion 331 and a plunger combining portion 332. The plunger body 330 is located in the cap moving space 203, and the plunger member 33 is a separate piece from the button cap 30 and from the plunger member 33. The plunger member 33 can be assembled prior to and independent of the button cap 30. This allows for ease of assembly where the button cap 30 can slide vertically past the abutting portion 331, permanently leaving plunger member 33 positioned properly for key actuation in both of the first axis x and the second axis y. The abutting portion 331 is connected to an end of the plunger body 330 and abuts against the second cap body 303 of the button cap 30. The plunger combining portion 332 is connected to another end of the plunger body 330.

In practical application, the plug member 32 is a water-proof plug. Furthermore, the plug member 32 includes a plug body 320, a first water-proof flange 321, a plug activating portion 322, a second water-proof flange 323 and a plug combining portion 324. The plug body 320 has a recessed space 325 formed therein, and the plug body 320 seals the through hole 204 on the inner separating wall 202, so as to prevent liquid from passing through the through hole 204. The first water-proof flange 321 protrudes from an end of the plug body 320 and seals an opening 205 between the cap moving space 203 and the through hole 204, so as to prevent the liquid from entering the through hole 204 via the opening 205. The plug activating portion 322 is connected to another end of the plug body 320 and contacts with the switch 31. The plug activating portion 322 seals an opening 326 between the recessed space 325 and the containing space 23, so as to prevent the liquid from entering the containing space 23 via the opening 326. The second water-proof flange 323 protrudes from the plug activating portion 322 and seals an opening 206 between the through hole 204 and the containing space 23, so as to prevent the liquid from entering the containing space 23 via the opening 206.

In such a manner, the plug member 32 is capable of preventing the liquid from entering the containing space 23 via the opening 205, 326, 206 and the through hole 204 respectively by the first water-proof flange 321, the plug activating portion 322, the second water-proof flange 323 and the plug body 320. In this embodiment, the plug member 32 is made of elastic materials, such as rubber, but the present invention is not limited thereto. In addition, the plug combining portion 324 protrudes from the plug activating portion 322 and dives into the recessed space 325. The plug combining portion 324 combines with the plunger combining portion 332, such that the plug member 32 is combined with the plunger member 33. In this embodiment, the plug combining portion 324 is an engaging post, and the plunger combining portion 332 is an engaging slot engaging with the engaging post. Structures of the plug combining portion 324 and the plunger combining portion 332 are not limited to those illustrated in figures in this embodiment, and it depends on practical demands.

As shown in FIG. 3, the casing 2 has a first casing surface 24 and a second casing surface 25, the first cap body 302 has a first outer surface 304, and the second cap body 303 has a second outer surface 305. Thus, the first outer surface 304 and the second outer surface 305 provide user's fingers with places to contact. Furthermore, the first outer surface 304 corresponds to the first casing surface 24, and the second outer surface 305 corresponds to the second casing surface 25 for the sake of appearance match.

As shown in FIG. 3, when the user touches the first outer surface 304 of the first cap body 302 at a first position P1 spaced from the cap pivotal portion 301 by a first distance D1 along the first axis X, i.e., when the first cap body 302 is applied by an external force F1 at the first position P1 spaced from the cap pivotal portion 301 by the first distance D1 along the first axis X, the external force F1 and the first distance D1 along the first axis X will result in a moment M1 for the button cap 30 about the casing pivotal portion 22 of the casing 2, wherein the moment M1, the external force F1 and the first distance D1 along the first axis X follow the right-hand rule. As a result, the button cap 30 will be activated by the external force F1 or by a touch by the user's finger on the first outer surface 304 of the first cap body 302, such that the button cap 30 rotates in an activating direction R1. Since the moment M1, the external force F1 and the first distance D1 along the first axis X follow the right-hand rule, the activating direction R1 is a clockwise direction based on relative positions between the external force F1 and the first distance D1 along the first axis X in this embodiment, as shown in FIG. 3.

When the button cap 30 rotates in the activating direction R1, the second cap body 303 drives the plunger member 33 to move inwardly, such that the plunger combining portion 332 enables the plug activating portion 322 of the plug member 32 to deform inwardly. Accordingly, the plug activating portion 322 of the plug member 32 activates the switch 31, such that the key device 3 is able to generate an input instruction for performing the input operation by the user, such as activating a graphical user interface, turning on the portable electronic device and so on.

It should be noticed that the detached plunger member 33 allows the pivot motion of the second cap body 303 of the button cap 30 to always press the plunger member 33 at the same angle. In other words, since the plunger member 33 is separate from the button cap 30, i.e., the plunger member 33 and the button cap 30 are not integrally formed, it allows the plunger member 33 to slide instead of pivoting with the button cap 30 during the pivot motion of the button cap 30. As a result, structures that the plunger member 33 is separate from the button cap 30 ensures an angle of actuation of the switch 31 resulting from the plunger member 33 to be along the same direction as the switch (i.e., the inward direction), which would make the design unsusceptible to wear and would positively affect the tactility of the system.

Alternatively, when the user touches the second outer surface 305 of the second cap body 303 at a second position P2 spaced from the cap pivotal portion 301 by a second distance D2 along the second axis Y, i.e., when the second cap body 303 is applied by an external force F2 at the second position P2 spaced from the cap pivotal portion 301 by the second distance D2 along the second axis Y, the external force F2 and the second distance D2 along the second axis Y will result in a moment M2 for the button cap 30 about the casing pivotal portion 22 of the casing 2, wherein the moment M2, the external force F2 and the second distance D2 along the second axis Y follow the right-hand rule. As a result, the button cap 30 will be activated by the external force F2 or by a touch by the user's finger on the second outer surface 305 of the second cap body 303, such that the button cap 30 rotates in the activating direction R1. Since the moment M2, the external force F2 and the second distance D2 along the second axis Y follow the right-hand rule, the activating direction R1 is a clockwise direction based on relative positions between the external force F2 and the second axis Y along the second axis Y in this embodiment, as shown in FIG. 3. The principles of the external force F2 to activate the switch 31 is identical to that of the external force F1, and related description is omitted herein for simplicity.

On the other hand, when the user is no longer press the first outer surface 304 of the first cap body 302 or no longer press the second outer surface 305 of the second cap body 303, i.e., when the first outer surface 304 of the first cap body 302 is released from the external force F1 or when the second outer surface 305 of the second cap body 303 is released from the external force F2, the switch 31 and/or the plug member 32 made of elastic materials drive the button cap 30 to rotate about the casing pivotal portion 22 in a released direction R2 opposite to the activating direction R1, so as to recover the button cap 30.

It should be noticed that the rear housing 20 further has a flange retention structure 207 protruding from the outer lateral wall 201, and the button cap 30 further includes a flange structure 34 protruding from the second cap body 303. When the button cap 30 rotates in the released direction R2, the flange structure 34 of the button cap 30 abuts against the flange retention structure 207, such that the button cap 30 is stopped by the flange retention structure 207 in a recovery position.

Compared to the prior art, the button cap of the key device includes the cap pivotal portion pivoted to the casing pivotal portion of the casing of the electronic device, and further the button cap includes the first cap body extends from the cap pivotal portion along the first axis, and the second cap body extends from the first cap body along the second axis. As a result, the user is able to selectively touch the first cap body or the second cap body to drive the button cap to rotate in the activating direction, so as to activate the switch for generating the input instruction, such as activating a graphical user interface, turning on the electronic device and so on.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. An electronic device comprising:

a casing having a casing pivotal portion, a first casing surface facing an exterior side of the casing and a second casing surface facing another exterior side of the casing; and a key device installed on the casing and comprising a button cap, the button cap comprising:

a cap pivotal portion pivoted to the casing pivotal portion;

a first cap body extending from the cap pivotal portion along a first axis, the first cap body having a first outer surface which is oriented corresponding to the first casing surface and exposed on the first casing surface; and a second cap body extending from the first cap body along a second axis, the second cap body having a second outer surface which is oriented corresponding to the second casing surface and exposed on the second casing surface, the button cap rotating in an activating direction when the first cap body is applied by an external force at a first position spaced from the cap pivotal portion by a first distance along the first axis or when the second cap body is applied by the external force at a second position spaced from the cap pivotal portion by a second distance along the second axis.

2. The electronic device of claim 1, wherein the casing comprises:

a rear housing; and a front housing installed on the rear housing, wherein the casing pivotal portion is disposed on the front housing.

3. The electronic device of claim 2, wherein the rear housing has an outer lateral wall, an inner separating wall and a flange retention structure protruding from the outer lateral wall, a cap moving space is defined between the outer lateral wall and the inner separating wall, the second cap body is movably disposed inside the cap moving space, and the button cap further comprises:

a flange structure protruding from the second cap body, the flange structure abutting against the flange retention structure when the button cap rotates in a released direction opposite to the activating direction.

4. The electronic device of claim 3, wherein a containing space is formed inside the casing, the inner separating wall separates the cap moving space from the containing space, a through hole is formed on the inner separating wall and communicates the cap moving space with the containing space, the electronic device further comprises a circuit board installed inside the containing space, and the key device further comprises:

a switch coupled to the circuit board; and a plug member plugging in the through hole, the second cap body driving the plug member to activate the switch when the button cap rotates in the activating direction.

5. The electronic device of claim 4, wherein the key device further comprises:

a plunger member disposed between the second cap body and the plug member.

6. The electronic device of claim 5, wherein the plunger member comprises:

a plunger body located in the cap moving space;

an abutting portion connected to an end of the plunger body and abutting against the second cap body; and a plunger combining portion connected to another end of the plunger body and combining with the plug member.

7. The electronic device of claim 6, wherein the plug member comprises:

a plug body with a recessed space formed therein and sealing the through hole;

a first water-proof flange protruding from an end of the plug body and sealing an opening between the cap moving space and the through hole;

a plug activating portion connected to another end of the plug body and contacting with the switch, the plug activating portion sealing an opening between the recessed space and the containing space;

a second water-proof flange protruding from the plug activating portion and sealing an opening between the through hole and the containing space; and a plug combining portion protruding from the plug activating portion and combining with the plunger combining portion.

8. The electronic device of claim 5, wherein the plunger member is a separate piece from the button cap and from the plug member.

9. The electronic device of claim 1, wherein the first cap body has a first outer surface, the second cap body has a second outer surface, the casing has a first casing surface and a second casing surface, the first outer surface corresponds to the first casing surface, and the second outer surface corresponds to the second casing surface.

10. The electronic device of claim 1, wherein the casing pivotal portion is a protruding rib, and the cap pivotal portion is a recessed slot.

11. The electronic device of claim 1, wherein the first axis is perpendicular to the second axis.

12. An electronic device comprising:

a casing having a casing pivotal portion, a first casing surface facing an exterior side of the casing and a second casing surface facing another exterior side of the casing;

a circuit board installed inside the casing; and a key device installed on the casing and comprising a button cap and a switch coupled to the circuit board, the button cap comprising:

a cap pivotal portion pivoted to the casing pivotal portion;

a first cap body extending from the cap pivotal portion, the first cap body having a first outer surface which is oriented corresponding to the first casing surface and exposed on the first casing surface; and a second cap body extending from the first cap body, the second cap body having a second outer surface which is oriented corresponding to the second casing surface and exposed on the second casing surface, the button cap rotating in an activating direction when the first cap body or the second cap body is applied by an external force to activate the switch.

13. The electronic device of claim 12, wherein the first cap body is applied by the external force at a first position spaced from the cap pivotal portion by a first distance along a first axis and the second cap body is applied by the external force at a second position spaced from the cap pivotal portion by a second distance along the second axis perpendicular to the first axis.

14. The electronic device of claim 12, wherein the key device further comprises:

a plug member disposed between the second cap body and the switch, the second cap body driving the plug member to activate the switch when the button cap rotates in the activating direction.

* * * * *